US005752677A

United States Patent [19]

Richley

[11] Patent Number: 5,752,677

[45] Date of Patent: May 19, 1998

[54] BLOCK OCCUPANCY DETECTOR FOR MODEL RAILROADS

[76] Inventor: Edward Anthony Richley, 4392 Silva Ct., Palo Alto, Calif. 94306

[21] Appl. No.: 745,447

[22] Filed: Nov. 12, 1996

[51] Int. Cl.[6] ..... B61L 13/00

[52] U.S. Cl. ..... 246/122 A; 246/34 R; 246/246; 246/249; 246/255

[58] Field of Search ..... 246/122 A, 122 R, 246/124, 34 R, 40, 34 B, 77, 28 K, 246, 247, 249, 255; 340/988, 989

[56] References Cited

U.S. PATENT DOCUMENTS

| | | | |
|---|---|---|---|
| 2,460,597 | 2/1949 | Rodgers | 246/122 R |
| 3,333,096 | 7/1967 | Ohman et al. | 246/122 R |
| 4,351,504 | 9/1982 | Frielinghaus | 246/122 R |
| 4,469,298 | 9/1984 | Uebel | 246/249 |
| 4,487,385 | 12/1984 | Salmon | 246/34 R |
| 5,145,131 | 9/1992 | Franke | 246/122 R |
| 5,417,388 | 5/1995 | Stillwell | 246/122 A |

OTHER PUBLICATIONS

P. Mallery, "Electrical Handbook for Model Railroads", (1955) pp. 174–190.

L. H. Westcott, "Twin-T Signalling", Model Railroader, Jun., 1958 pp. 36–41.

C. Small, A. Madle, Model Railroader, Jul. 1947, pp. 536–539.

Hibbs, May, Model Railroader, Sep. 1947, pp. 742–744.

van Allen, Electronics, Dec. 1949, pp. 148–156.

L. H. Westcott, Model Railroader, Mar. 1950, pp. 62–64.

*Primary Examiner*—Mark T. Le

[57] ABSTRACT

This invention pertains to model railroads and specifically to the problem of detecting the presence or absence of cars, locomotives, or obstructions which may occupy a particular section of track. Modulated signals of radio frequency are applied to the track via a balanced transformer and detected synchronously. A circuit is provided for nulling the detected signal in the absence of any occupation in such a manner that any change in detected signal represents an item which occupies that track section. The use of radio frequency signals and synchronous detection enables the system to be very sensitive, and to detect objects which do not necessarily form a direct current path across the rails.

26 Claims, 4 Drawing Sheets

BLOCK OCCUPANCY DETECTOR FOR MODEL RAILROADS

BACKGROUND OF THE INVENTION

This invention pertains to model railroads in which track and equipment are miniature scale models of full sized equipment. Model railroads have long been built with the inclusion of signal systems designed to imitate the signalling practices of their prototypes. One component of such a signal system is the block occupancy detector. The block occupancy detector is responsible for detecting the presence of any object which spans the rails within a particular section of track (a block). Many types of block occupancy detectors have been utilized over the years. Mechanical switches, electrical relays, transistors, and integrated circuits have all been used in one form or another.

Many early systems used a relay coil placed in series between the track section and the propulsion power supply which powered the locomotives (see "Electrical Handbook for Model Railroads" by Paul Mallery, Simmons-Boardman, 1955). Schemes based on this method utilized the fact that the current drawn by a locomotive is substantial enough to trip the series-connected relay. Variations on this method have been created which allow less substantial loads to be detected. For example, the light bulb within a model passenger car could draw enough current to trip a more sensitive relay. These variations utilize an additional higher voltage power supply and are encumbered by the need to prevent false detection by currents which could flow back through the propulsion power supply. These relay based systems are based on direct current (DC) and only operate when a device which will conduct direct current (a DC load) is presented to the track.

When solid state devices became available, they began to replace relay circuits. Westcott's "Twin-T" circuit (Model Railroader, June 1958, p. 36) is an example of such a system. Again, only a locomotive or car presenting a DC load will be detected. Variations on this method have been made with more sensitive and less expensive components as transistors became less expensive and integrated circuits became available, but the DC load limitation persisted.

With these limitations, it has been inconvenient to imitate the practice of full scale railroads in which any rolling stock can be detected by the block occupancy detector. In the practice of full sized railroads, the rails are normally insulated from each other. Any car, locomotive, hand car, or other metal obstruction which spans the rails is detectable because it forms a connection between the rails. In general, this connection is considered to be a very low resistance direct connection. Model railroads tend to provide electrical power for locomotives and car borne accessories from the two rails. A short circuit across these rails is thus very undesirable. For this reason, wheels on opposite sides of model cars which do not require electrical power are carefully insulated from each other. Thus, detection of the presence of the vast majority of model cars has been difficult and largely neglected.

One method for circumventing this limitation on model railroads has been to provide a highly resistive conduction path across the rails on all cars. This is accomplished either through resistors connected to the wheels, or through the use of conductive paint applied so as to span the insulation between opposing wheels. This practice is generally unsightly, unreliable, and inconvenient.

Some low frequency (60 Hz) occupancy detection circuits have been described. The method of Small (Model Railroader, July 1947) requires that cars be equipped with resistors.

The method of Madle (Model Railroader, July 1947) utilizes high frequency alternating current but with the requirement that cars be outfitted with capacitors to bridge the rails. The sensitivity of this scheme must be limited so that the stray capacitance of the track, itself, does not cause an indication of occupancy, whereas the additional capacitance of a properly outfitted car will cause such an indication.

In 1947 Hibbs and May are mentioned as having developed a method utilizing high frequency alternating current for occupancy detection (Model Railroader, September 1947, p. 742). The circuit was said to detect a change in capacitance between the rails such as that caused by the presence of metal wheels insulated from their axles. Insufficient details are given to determine the method of operation of the circuit or its effectiveness.

Van Allen describes a scheme based on high frequency alternating current (Electronics, December 1949, p. 148, also described in Model Railroader, March 1950, p63) which overcomes some of the limitations of the scheme of Madle. In Van Allen's method, the rails become part of a resonator which is weakly coupled to a high frequency oscillator by a resonant transformer with tunable secondary. The strength of the resonance is detected with a diode. In operation, the transformer is tuned for peak detected output with the track unoccupied. The presence of a suitably equipped car will take the resonator out of resonance and the detected output will subsequently drop. Van Allen claimed that cars which are equipped with capacitance as low as 10 picofarads can be detected with this circuit.

BRIEF DESCRIPTION OF THE INVENTION

In order to accurately imitate the practice of full scale railraods while providing propulsion power through two rails, some means of detecting cars which do not present a DC load is needed. The present invention accomplishes this with an electronic circuit which uses a high frequency alternating current signal to detect any change in track impedance. This change could be inductive, resistive, or, most commonly, capacitive. Furthermore, the circuit is designed to detect deviations from a null condition, rather than a peak, so that adequate gain can be provided to allow its sensitivity to be very high. Unmodified cars with capacitance as low as 1 picofarad can be detected.

In addition to the AC signal, appropriate signal processing circuitry is provided so that inadvertent signals from any of various sources do not cause interference. In particular, propulsion motors can cause inadvertent signals in the frequency range chosen for the carrier frequency. Furthermore, there is a growing trend in the model railroad hobby toward using digital signals superimposed on the propulsion power for the control of locomotives and accessories. This practice is known as digital command control. These digital signals contain a significant amount of energy in the part of the radio frequency spectrum where it is most desirable to operate the signal detection scheme of this invention.

The present invention is implemented by providing a radio frequency carrier signal modulated according to a lower frequency digital sequence. This modulated signal is presented to a balanced transformer. The balanced transformer is connected to the track section in which it is desired to detect occupancy, and also to a nulling network which is adjusted to produce a null condition in the secondary of the balanced transformer when the track section is unoccupied. The signal from the balanced transformer secondary is amplified and asynchronously detected. Under null conditions, this detection will produce a relatively small component of a signal corresponding to the modulated carrier. Any imbalance in the circuit comprising the balanced transformer, track section, and nulling network, such as from the presence of a locomotive or car, will produce an increase in the component of the output of the asynchronous detector corresponding to the modulated carrier signal. Synchronous detection of the output of the asynchronous detector produces a signal with a DC component representing the strength of the modulated carrier signal at the output of the balanced transformer. A change in track impedance resulting from occupancy results in a change in this DC component. Sufficient gain and filtering of this synchronous detection output signal can be performed to reliably detect occupancy of the track section for cars which present only a slight capacitance, while preventing false detection from inadvertent signals.

DETAILED DESCRIPTION

Figure 1:
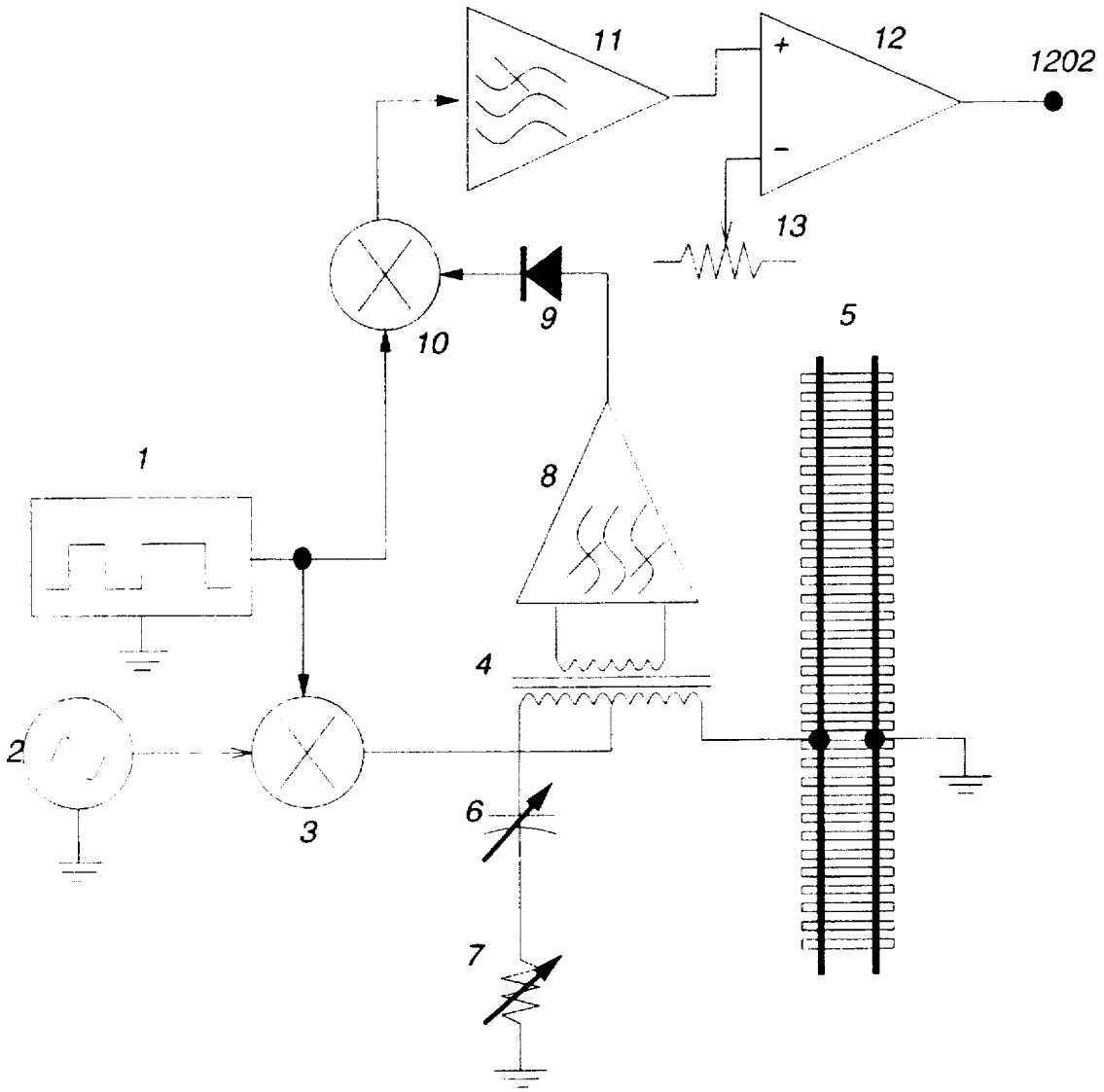
FIG. 1 shows a block diagram of a complete system according to the invention with digital sequence generator 1, carrier oscillator 2, modulator 3, balanced transformer 4, track section 5, variable capacitance 6, variable resistance 7, radio frequency amplifier 8, asynchronous detector 9, synchronous detector 10, low pass filter 11, comparator 12, and threshold adjustment 13.

FIG. 1 shows a block diagram of an exemplary embodiment of the invention. A carrier frequency oscillator 2 is connected to one input port of a modulator 3. A digital sequence generator 1 is connected to the other input port of modulator 3. The output of modulator 3 is thus a signal at the frequency of carrier frequency oscillator 2, but with amplitude modulation according to digital sequence generator 1. A section of model railroad track 5 is connected to a balanced transformer 4. In practice, the section of track represents one block of a larger model railroad, wherein it is desired to detect occupancy.

A typical block in HO scale (3.5 mm corresponding to 1 foot) is several feet in length. This presents a predominantly capacitive impedance at a sufficiently low frequency that inductive effects are not significant. Although it can be considered to be a transmission line, the inductive effects of a typical block are insignificant at frequencies below about ten megahertz. Thus, the track impedance is mostly capacitive, but with some resistive component due to rail resistance or moisture content of the roadbed.

Balanced transformer 4 has a primary winding with a center tap which is connected to the output of modulator 3. The frequency of radio frequency oscillator 2 is chosen to be several megahertz, such that inductive effects of track section 5 are insignificant. The shortest pulse length of digital sequence generator 1 is chosen to contain many cycles of oscillator 2. Thus, digital sequence generator 1 operates at a significantly lower frequency than carrier oscillator 2. Variable capacitance 6 and variable resistance 7 can then be adjusted to provide a null in balanced transformer 4. This null corresponds to a situation in which the combined impedance of variable capacitance 6 and variable resistance 7 are substantially equal to the impedance of track section 5 at the frequency of oscillator 2. Under this null condition, the net magnetic flux in transformer 4 is nearly zero, and the voltage of the secondary winding of transformer 4 will be very low. This secondary winding is connected to amplifier 8, which is tuned to the frequency of oscillator 2. The output of amplifier 8 is connected to asynchronous detector 9.

Balanced transformer 4 is only maintained in a null condition for signals originating from modulator 3 and not for extraneous signals picked up by the track. Thus, the output of asynchronous detector 9 will contain any remnant small modulated signal derived from the secondary of balanced transformer 4 due to an incomplete null condition, along with any inadvertent signals which may have been picked up from track section 5.

Synchronous detector 10 has one input connected to the output of asynchronous detector 9 and the other input connected to digital sequence generator 1. The output of synchronous detector 10 is connected to the input of a low pass filter 11. The output of filter 11 thus corresponds to a correlation of the output of asynchronous detector 9 with the output of digital sequence generator 1. As long as amplifier 8 remains in its linear region of operation, the output of asynchronous detector 9 will contain a component which corresponds to the sequence of digital sequence generator 1. Under null conditions, this component will be very small. Furthermore, inadvertent signals contained in the output of asynchronous detector 9 will be suppressed at the output of filter 11 due to the fact that they will not properly correspond with the sequence provided by digital sequence generator 1. The average product of these extraneous signals with the output of digital sequence generator 1 will be zero.

Finally, the output of low pass filter 11 is connected to comparator 12, with a threshold settable by adjustment 13. In practice, adjustment 13 is set to a point slightly beyond that required to switch the output of comparator 12 when variable capacitance 6 and variable resistance 7 are adjusted for null with track section 5 unoccupied, such that the output of comparator 12 reliably indicates that track section 5 is unoccupied.

When variable capacitance 6, variable resistance 7, and adjustment 13 are adjusted according to the above description, any change in impedance of track section 5, such as caused by the entry of a model freight car onto track section 5, will cause balanced transformer 4 to lose its null condition. A larger signal which is modulated according to digital sequence generator 1 will be present at the output of amplifier 8. The modulation according to digital sequence generator 1 will be present in the output of asynchronous detector 9, and a correlation signal will be produced at the output of low pass filter 11. If this new signal is sufficiently strong, the output of comparator 12 will switch to indicate the occupied state of track section 5.

In practice, the capacitance of several feet of HO scale track is tens of picofarads. A typical unmodified model freight car with metal wheels, metal underbody, but plastic axles will present an additional capacitance of approximately 1 picofarad to such a section of track. Such a small capacitance change can be easily detected by a system according to this invention. The time constant of low pass filter 11 can be adjusted to larger values, and its gain correspondingly increased, so as to make the system as sensitive and discriminative as is necessary.

Other features of this invention which will be described in the following detailed description are exemplary methods to prevent interference with the operation of digital command control signals, methods to prevent interference from such digital command control signals with the operation of the occupancy detector, and suppression of undesirable radio frequency radiation from the track.

Figure 2:
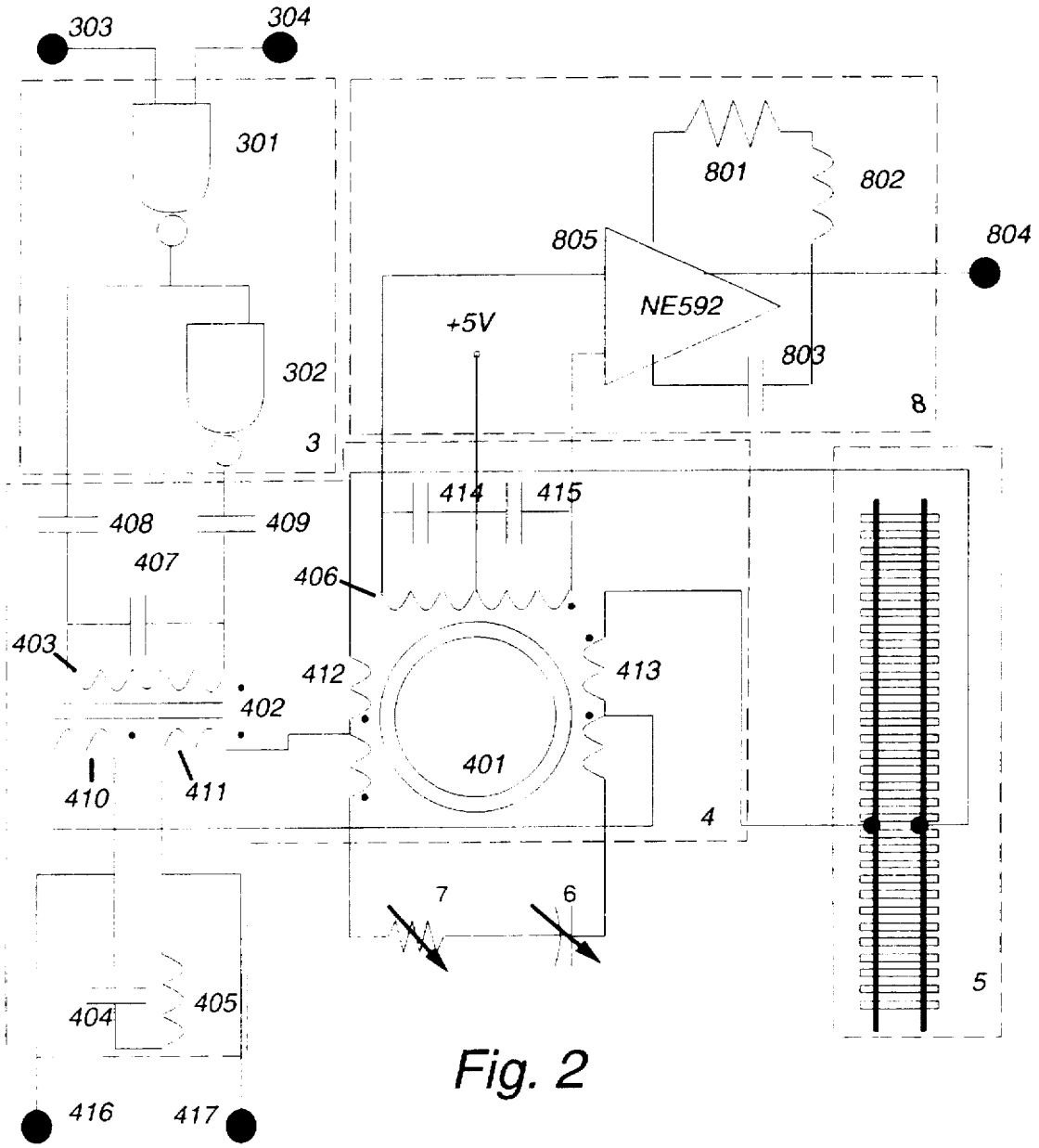
FIG. 2 shows details of an exemplary embodiment of the balanced transformer 4, modulator 3, and radio frequency amplifier 8.

Referring to FIG. 2 it will be seen that the balanced transformer 4 comprises two separate cores 401 and 402, tuning capacitors 407, 408, 409, 414, and 415, and a series resonant network comprising capacitor 404 and inductor 405. Propulsion power is introduced at terminals 416 and 417. Secondary windings 410 and 411 on core 402 as well as primary windings 412 and 413 on core 401 include a few turns of wire of sufficiently heavy gauge as to not present a significant resistive loss to the propulsion current. Furthermore, by operating with a sufficiently high carrier frequency, the inductance in the path of the propulsion current can be quite low. Control signals superimposed thereon are not substantially altered en route to track section 5. This winding arrangement thus substantially eliminates interference by the signal detection circuit with the operation of a digital command control system.

Modulator 3 comprises NAND gates 301 and 302. NAND gate 301 serves to perform the modulation function by gating a carrier signal presented to terminal 303 with a digital sequence presented to terminal 304. NAND gate 302 provides a signal of opposite phase to the output of NAND gate 301 so that core 402 can be driven in a balanced or "push-pull" manner. Capacitors 407, 408, and 409 together with the primary inductance of winding 403 produce a resonant circuit designed to suppress the harmonic components of the outputs of NAND gates 301 and 302. The result of this resonant circuit is that the voltage applied to winding 403 is a substantially harmonic-free sine wave at the fundamental frequency of the carrier signal, with amplitude modulation according to digital sequence generator 1.

Core 402 has secondary windings 410 and 411 connected to a series resonant circuit comprising capacitor 404 and inductor 405. Values of capacitor 404 and inductor 405 are chosen to obtain a series resonant condition at the carrier frequency. Furthermore, capacitor 404 must be chosen so as to not introduce a substantial capacitive load to any control signals introduced with the propulsion current from terminals 416 and 417, which also appear across the series connected pair of capacitor 404 and inductor 405. Secondary windings 410 and 411 are also connected to primary windings 412 and 413 of core 401. Phasing of windings 410 and 411 is such that the components of the modulated carrier signal derived from primary winding 403 are combined constructively at the connections to windings 412 and 413.

The windings 412 and 413 of core 401 are symmetric and phased opposite each other so as to form a bridge circuit. One end of each winding, of opposite phase, is connected to track section 5. The opposite ends are connected to the nulling network comprising variable capacitance 6 and variable resistance 7. Secondary winding 406 is tuned by capacitors 414 and 415 to the carrier frequency and exhibits a voltage corresponding to the net flux in core 401. Under a null condition, the component of the modulated carrier present at the terminals of winding 406 will be minimal.

This null is the result of a balanced bridge, and is not caused by a resonance condition. Thus, the circuit is somewhat tolerant of carrier frequency drift. Furthermore, temperature compensation can be provided by matching the temperature dependence of the nulling network with that of the track. Variable resistance 7, for example, could be implemented as a network comprising an adjustable resistance and a suitable temperature dependent resistance, such as a thermistor. Likewise, variable capacitance 6 could be implemented as a network comprising an adjustable capacitor and a temperature dependent capacitor.

Other nulling network configurations can be implemented for various purposes. For example, the inclusion of some parallel resistance across capacitance 6 or across the combination of capacitance 6 and resistance 7 may provide a better null condition over a wider range of frequencies. This may improve the sensitivity of the circuit by helping to provide a null condition for any residual signal components at the harmonics of the carrier frequency.

As a result of the fact that the carrier signal path through all windings on cores 401 and 402 is balanced, only differential signals are presented to track section 5 and propulsion terminals 416 and 417. This has the effect of suppressing radio frequency radiation from track section 5. Furthermore, the carrier signal voltage presented to propulsion terminals 416 and 417 is not only balanced in the same manner, but also substantially suppressed by the series resonant circuit comprising capacitance 404 and inductance 405. Radiation from wiring leading to terminals 416 and 417 or from track section 5 is minimized by these means.

Secondary winding 406 is connected to the input of a radio frequency amplifier integrated circuit 805, such as the NE592 as sold by Signetics Corporation. Resistor 801, inductor 802, and capacitor 803 form a resonant circuit designed to give amplifier 805 some tuned response at the carrier frequency. This tuning, along with the tuning provided by winding 406 and capacitors 414 and 415, serves to suppress those components of unwanted extraneous signals which have spectral content sufficiently far from the carrier frequency. The output of amplifier 805 is available at terminal 804.

Figure 3:
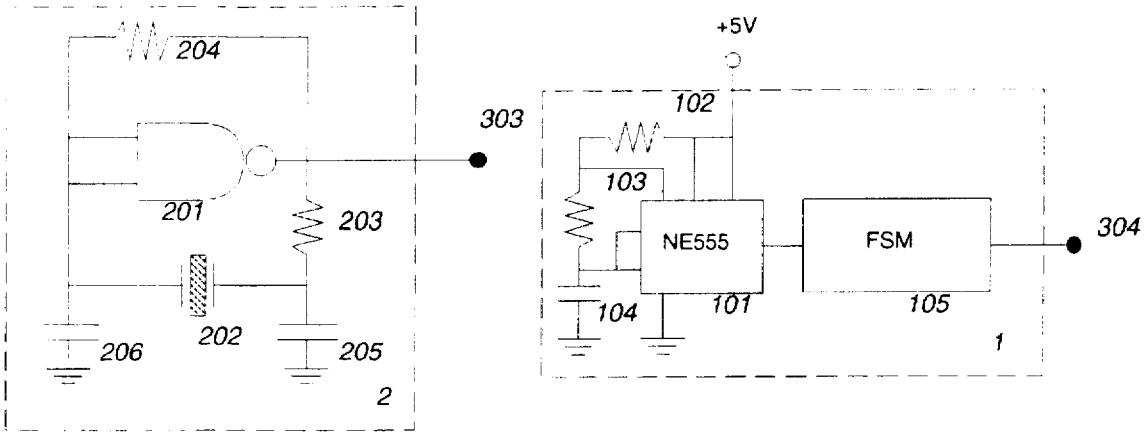
FIG. 3 shows details of an exemplary embodiment of carrier oscillator 2 and digital sequence generator 1.

The origin of the signals at terminals 303 and 304 can be seen in FIG. 3. Carrier generator 2 comprises a common Colpitts oscillator implemented with NAND gate 201. The frequency of quartz crystal 202 determines the carrier frequency. Resistor 204 serves to put NAND gate 201 in a linear mode of operation. Crystal 202, along with capacitors 205 and 206 form the Colpitts network, while resistor 203 serves mainly to increase the quality factor of the resonance. Output from this carrier signal generator is available at terminal 303. This circuit is commonly used in the electronics industry and is described in many references. Variations on this circuit are often made by replacing components 202, 205, and 206 with a less expensive network comprising an inductor and capacitors, but with some loss in frequency stability.

Also shown in FIG. 3 is digital sequence generator 1. An NE555 integrated circuit 101 (Signetics Corporation) is connected with resistors 102, and 103, and capacitor 104 to produce an astable condition with a frequency much lower than the carrier frequency. Typically, ten to one hundred Hertz is chosen. The output from oscillator 101 is taken to finite state machine (FSM) 105. This finite state machine can be of various forms. In a simple implementation it can comprise a simple toggle flip-flop and produce a periodic pulse train with 50 percent duty cycle. In a more sophisticated implementation, it can comprise a set of flip-flops arranged to form a pseudo-random sequence. Better rejection of interference can be expected from such pseudo-random sequences. The output is taken to terminal 304.

Figure 4:
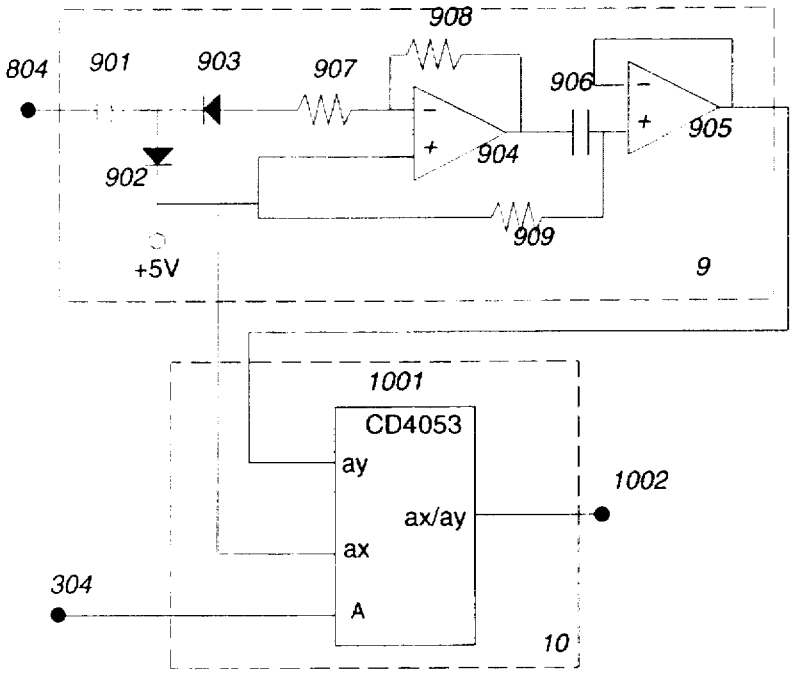
FIG. 4 shows details of an exemplary embodiment of asynchronous detector 9 and synchronous detector 10.

FIG. 4 shows asynchronous detector 9. Output of radio frequency amplifier 8 is presented to the input at terminal 804. Capacitor 901 and diodes 902 and 903 form a voltage-doubling detector. The output of this detector is applied to an amplifier comprising an integrated circuit operational amplifier 904, and resistors 907 and 908. The amplified detector output comprises a baseband signal representing the amplitude of the radio frequency signal present in core 401 in a band around the carrier frequency. As such, it can contain DC components such as could be produced by a continuous broadband source of interference. Capacitor 906 and resistor 909 form a high pass filter which serves to eliminate any such DC component while allowing the time-varying component, such as that due to the presence of modulated carrier signal, to pass. Operational amplifier 905 is connected as a voltage follower which, owing to the connection of resistor 909 to a constant reference voltage, has a known average output. The output of operational amplifier 905 and, hence, of asynchronous detector 9, comprises a component corresponding to the modulated carrier due to any imbalance in core 401 and a component due to any time-varying interference signal near the carrier signal, both of which are superimposed on a known constant reference voltage.

FIG. 4 also shows synchronous detector 10 implemented with CMOS analog switch 1001 which comprises a CD4053 integrated circuit sold by National Semiconductor Corporation. This analog switch has two analog inputs and one analog output. One analog input is connected to the output of asynchronous detector 9, and the other is connected to the constant reference voltage. Terminal 304 is connected to the control pin which is a logic input and determines which analog input is connected to the output. Terminal 304 is connected to the output of digital sequence generator 1 and as such will cause the output of analog switch 1001 to alternately be connected to the constant reference voltage or to the output of asynchronous detector 9, synchronously with the modulation of the carrier signal. As a result, any output of asynchronous detector 9 which is synchronous with the modulation of the carrier signal according to digital sequence generator 1 will contribute to a change in the DC component of the output of synchronous detector 10, whereas any output of asynchronous detector 9 which is not synchronous with digital sequence generator 1 will sometimes add and sometimes subtract from the output of synchronous detector 10 and, on average, contribute zero to its DC level. The output of synchronous detector 10 is taken to terminal 1002.

Figure 5:
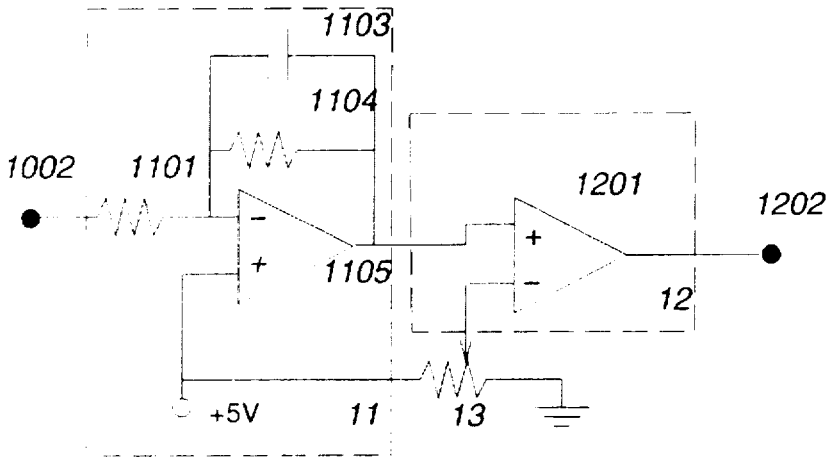
FIG. 5 shows details of an exemplary embodiment of low pass filter 11, comparator 12, and threshold adjustment 13.

FIG. 5 shows how the output of synchronous detector 10 is amplified and filtered to magnify its DC component. Integrated circuit operational amplifier 1105 is configured as an inverting amplifier by its connections with resistors 1101 and 1104. Furthermore, capacitor 1103 serves to set a low pass frequency for this amplifier. The non-inverting input of operational amplifier 1105 is connected to the same constant reference voltage used in asynchronous detector 9 and synchronous detector 10. Thus, differences in voltage at terminal 1002 from this reference are amplified and filtered by filter 11. The low pass frequency is chosen to be far less than the frequency of oscillator 101 and such that extraneous interference signals do not contribute to the output of operational amplifier 1105 when the gain, as determined by resistors 1101 and 1104, is set sufficiently high so as to produce a detectable change in the output of operational amplifier 1105 when track section 5 is occupied by a model car with the smallest amount of capacitance which the system is required to detect. In practice, a low pass frequency of several tenths of a Hertz is necessary. Comparator 12, implemented with an integrated circuit operational amplifier or comparator 1201, has a threshold as set by adjustment 13, and is connected to the output of filter 11 so as to indicate this change with a logical output at terminal 1202.

In practice, the null condition is obtained by adjustment of variable capacitance 6 and variable resistance 7 until a minimal voltage difference is obtained between the output of filter 11 and the constant reference voltage, when track section 5 is unoccupied. Adjustment 13 is then adjusted so that output 1202 indicates the unoccupied condition, but also such that the presence of a car with minimal capacitance in track section 5 indicates an occupied condition.

It should be understood that numerous changes in details of construction and the combination and arrangement of elements and materials may be resorted to without departing from the true spirit and scope of the invention as hereinafter claimed.

I claim:

1. A system for detecting occupancy of a section of track comprising:

a nulling network, coupled to said section of track, adjusted to produce a null condition when said section is unoccupied; and a detection circuit, coupled to said nulling network, to detect deviation from said null condition so as to indicate occupancy of said section of track; wherein said detection circuit comprises a synchronous detector.

2. A system according to claim 1, further comprising:

a balanced transformer connected to said section of track, said detection circuit, and said nulling network.

3. A system according to claim 2, further comprising:

a modulator, connected to said balanced transformer.

4. A system according to claim 3, further comprising:

a carrier signal source, connected to said modulator.

5. A system according to claim 4, further comprising:

a modulation source, connected to said modulator.

6. A system for detecting occupancy of a section of track comprising:

a nulling network, coupled to said section of track, adjusted to produce a null condition when said section is unoccupied;

a detection circuit, coupled to said nulling network, to detect deviation from said null condition so as to indicate occupancy of said section of track;

a balanced transformer connected to said section of track, said detection circuit, and said nulling network;

a modulator, connected to said balanced transformer;

a carrier signal source, connected to said modulator;

a modulation source, connected to said modulator;

wherein said detection circuit comprises a synchronous detector.

7. A system according to claim 6, wherein:

said modulation source is connected to said synchronous detector.

8. A system according to claim 7, further comprising:

a low pass filter, connected to the output of said synchronous detector.

9. A system according to claim 8, further comprising:

a comparator, connected to the output of said low pass filter.

10. A method for detecting the occupancy of a section of track comprising the steps of:

producing a null condition when said section is unoccupied; and detecting a deviation from said null condition when said section is occupied by measuring a signal derived by means of synchronous detection.

11. A method according to claim 10, wherein said step of producing a null condition comprises:

adjusting a nulling network.

12. A method according to claim 11, wherein said step of detecting a deviation further comprises:

connecting a balanced transformer to said section of track and to said nulling network.

13. A method for detecting the occupancy of a section of track comprising the steps of:

producing a null condition when said section is unoccupied; and detecting a deviation from said null condition when said section is occupied; wherein said step of producing a null condition comprises the step of adjusting a nulling network;

said step of detecting a deviation further comprises the step of applying a modulated carrier signal to said section of track and to said nulling network;

said step of applying a modulated carrier signal further comprises connecting a balanced transformer to said section of track and to said nulling network; and wherein said step of detecting a deviation further comprises measuring a signal derived from said balanced transformer by means of synchronous detection.

14. A method according to claim 13, wherein said step of detecting a deviation further comprises:

detecting a change in the result of said measurement corresponding to occupancy of said section.

15. A system for detecting occupancy of a section of track comprising:

a signal source;

a balanced transformer, connected between said signal source and said section of track;

a nulling network, coupled to said balanced transformer, adjusted to produce a null condition when said section is unoccupied; and a detection circuit, coupled to said balanced transformer, to detect deviation from said null condition so as to indicate occupancy of said section of track.

16. A system according to claim 15 wherein:

said signal source comprises a carrier signal source.

17. A system according to claim 15 wherein said signal source comprises:

a modulator; and a carrier signal source, connected to said modulator.

18. A system according to claim 17 further comprising:

a modulation source, connected to said modulator.

19. A system according to claim 18 wherein said detection circuit comprises:

a synchronous detector.

20. A system for detecting occupancy of a section of track comprising:

a signal source;

a nulling network, coupled to said section of track, adjusted to produce a null condition when said section is unoccupied; and a detection circuit, coupled to said nulling network, to detect deviation from said null condition so as to indicate occupancy of said section of track; wherein said section of track is arranged to present a predominantly capacitive impedance at the frequencies generated by said signal source.

21. A system according to claim 20, wherein said nulling network comprises a capacitor.

22. A system according to claim 20, further comprising:

a balanced transformer connected to said section of track, said detection circuit, and said nulling network.

23. A system according to claim 22 wherein:

said signal source comprises a carrier signal source.

24. A system according to claim 22 wherein said signal source comprises:

a modulator; and a carrier signal source, connected to said modulator.

25. A system according to claim 24 further comprising:

a modulation source, connected to said modulator.

26. A system according to claim 25 wherein said detection circuit comprises:

a synchronous detector.

* * * * *